United States Patent [19]

Nilssen

[11] Patent Number: 4,688,154

[45] Date of Patent: Aug. 18, 1987

[54] TRACK LIGHTING SYSTEM WITH PLUG-IN ADAPTERS

[76] Inventor: Ole K. Nilssen, Caesar Dr., Barrington, Ill. 60010

[21] Appl. No.: 660,795

[22] Filed: Oct. 15, 1984

Related U.S. Application Data

[63] Continuation-in-part of Ser. No. 543,302, Oct. 19, 1983, abandoned.

[51] Int. Cl.[4] ..... F21V 21/34

[52] U.S. Cl. ..... 362/147; 362/404; 307/157; 315/174; 315/312; 315/184; 363/159; 439/115

[58] Field of Search ..... 362/145, 147, 148, 150, 362/153, 217, 219, 220, 221, 225–228, 232, 235–237, 241–243, 247, 249–251, 254, 382, 388, 391, 404, 408, 418, 419, 801; 339/20, 21 R, 22 R, 23; 174/72 R, 72 C; 307/150, 151, 154, 157; 323/355, 359, 361; 363/8, 143, 146, 157, 159, 171, 172; 315/8, 62, 157–177, 295, 298, 184, 312; 340/792, 815.12; 361/341, 342

[56] References Cited

U.S. PATENT DOCUMENTS

| | | | |
|---|---|---|---|
| 2,590,483 | 3/1952 | Volz | 363/167 X |
| 3,295,050 | 12/1966 | Rowan, Jr. et al. | 363/171 |
| 3,349,317 | 10/1967 | Kobayashi et al. | 363/171 |
| 3,760,133 | 9/1973 | Howard | 339/21 R X |
| 3,832,503 | 8/1974 | Crane | 339/21 R X |
| 3,832,673 | 8/1974 | Le Hir | 339/21 R |
| 4,181,388 | 1/1980 | Donato | 339/21 R |
| 4,256,357 | 3/1981 | Vasseur et al. | 339/21 R |
| 4,279,456 | 7/1981 | Zucchini | 339/21 R X |
| 4,414,617 | 11/1983 | Galindo | 362/285 X |
| 4,494,808 | 1/1985 | Widell et al. | 339/21 R |
| 4,591,764 | 5/1986 | Nilssen | 362/404 X |

OTHER PUBLICATIONS

"Lytespan Track Lighting Systems", Lightolier, Jan., 1982.

*Primary Examiner*—Willis R. Wolfe, Jr.

[57] ABSTRACT

Subject track lighting system comprises a more-or-less regular lighting track having at least two pairs of track conductors. Of these track conductors, an initial pair carries the regular 120 Volt/60 Hz power line voltage. Plugged into the track and connecting with the initial pair of track conductors is one or more voltage-conditioning adapters—with each such adapter receiving its input voltage from the initial pair of track conductors and providing its conditioned output voltage to one of the other pairs of track conductors. Thus, depending upon the particular functions provided by the adapters, the different pairs of track conductors may be used in independently different ways. For instance, with one adapter being a frequency converter with an output voltage of 12 Volt/30 kHz, the pair of track conductors to which its output is connected may be used directly with low-voltage Halogen lamps—while ordinary 120 Volt incandescent lamps may simultaneously be used with the initial pair of track conductors. Thus, in this particular case, the same multi-conductor track can directly and conveniently power both low-voltage and high-voltage lamps. Functions suitable to provide in the form of subject adapters include: voltage magnitude transformation, voltage frequency transformation, time-programmable switching, remote operation, power line isolation, dimming, current limitation, and various combinations of all of these.

29 Claims, 6 Drawing Figures

TRACK LIGHTING SYSTEM WITH PLUG-IN ADAPTERS

This application is a continuation-in-part of U.S. patent application Ser. No. 06/543,302 filed on Oct. 19, 1983, now abandoned.

BACKGROUND OF THE INVENTION

1. Field of the Invention

The present invention relates to track lighting systems, particularly of a kind having multiple pairs of track conductors.

2. Description of Prior Art

Track lighting systems are being made by several companies. One such company is Lightolier Incorporated, Jersey City, N.J. 07305; whose track lighting systems and products are described in their Brochure No. 27022-LTS.

Conventional track lighting systems are designed to operate from a conventional utility power line and to have regular 120 Volt/60 Hz voltage on the track conductors. A track may have one or more pairs of such track conductors. The lighting units plugged into the track must be able to operate directly from this 120 Volt/60 Hz voltage.

Low voltage incandescent lamps, particularly Halogen lamps, have proven to be particularly attractive for track lighting purposes, and are being used to a growing degree. However, these low-voltage/Halogen lamps are designed to operate at a voltage of 12 Volt or less, and therefore have to be powered by way of voltage step-down transformation means. Thus, at present, whenever low-voltage/Halogen lamps are being used in track lighting systems, each such low-voltage/Halogen lamp has to be powered by way of such a voltage step-down transformation means; which implies that each lighting unit has to contain such a voltage step-down transformation means—a practice that results in costly, large and relatively heavy track lighting units.

The use of a single large step-down transformer capable of providing power at a suitably low voltage to a complete track has been considered and actually implemented in some situations. However, the efficiency, size and weight of such a transformer are distinctly unattractive. Moreover, such a track could then be used only with low-voltage lamps—effectively precluding the use in that track of regular 120 Volt/60 Hz lamps.

Against this background it appears useful to provide a track system with two pairs of track conductors and an adapter means operable to connect between these two pairs and to convert the ordinary 120 Volt/60 Hz voltage on the one pair into a low-magnitude voltage for the other pair. Then, both high- and low-voltage lamps may be used with the same track.

SUMMARY OF THE INVENTION

OBJECTS OF THE INVENTION

An object of the present invention is that of providing for an improved and more flexible track lighting system.

This as well as other objects, features and advantages of the present invention will become apparent from the following description and claims.

BRIEF DESCRIPTION

The present invention relates to a track lighting system having a number of interconnected power track sections, and wherein each power track section comprises at least a first and a second pair of track conductors—with the first pair of each section being connected together and powered with a primary supply voltage, such as the regular 120 Volt/60 Hz power line voltage, but with the other pair of track conductors of each section being left electrically non-connected. Both pairs of track conductors are electrically accessible to plug-in units adapted to be received and held by the track. Most of these plug-in units will normally be various kinds of lighting means; but, by virtue of the present invention, some of these plug-in units will be voltage-conditioning adapters operable to connect between the two pairs of track conductors and to convert or condition the voltage derived from a first pair before applying it to a second pair.

In the preferred embodiment, subject track lighting system comprises a more-or-less regular power track consisting of several interconnected track sections, with each track section having a first, a second and a third pair of track conductors. The first pair of track conductors of one section is permanently connected with the regular 120 Volt/60 Hz power line—with the first pair of track conductors of each of the other sections being connected with the first pair of track conductors of this one section by way of disconnectable connect means, thereby providing for 120 Volt/60 Hz voltage to be present on the first pair of track conductors of each track section. Before the insertion into the power track of any power conditioning means, both the second and the third pair of track conductors of each track section are electrically non-connected. Plugged into the power track and connecting with the first pair of track conductors are several voltage-conditioning adapters—with each such adapter receiving its input voltage from the first pair of track conductors and providing its conditioned output voltage to one of the other pairs of track conductors.

Thus, depending upon the particular functions provided by the adapters, the different pairs of track conductors of the different track sections may be used in independently different ways. For instance, one adapter—being a voltage and frequency converting adapter with an output voltage of 12 Volt/30 kHz—is connected between the first and the second pair of track conductors of one of the several track sections, thereby providing 12 Volt/30 kHz voltage on the second pair of track conductors of that track section; which therefore permit 12 Volt Halogen lamps to be powered by direct connection to the second pair of track conductors of that track section, while ordinary 120 Volt incandescent lamps may simultaneously be used with the first pair of track conductors of the same track section. In other words, in this particular case, the same power track can directly and conveniently power a plurality of both low-voltage and high-voltage incandescent lamps.

Functions suitable to provide in the form of subject adapters include: direct electrical connection with or without switching means, time-programmable switching, remote operation and/or switching, power line isolation, dimming, current limitation, voltage magnitude transformation, frequency transformation, and various combinations thereof.

DESCRIPTION OF TYPICAL PRIOR ART

Figure 1:
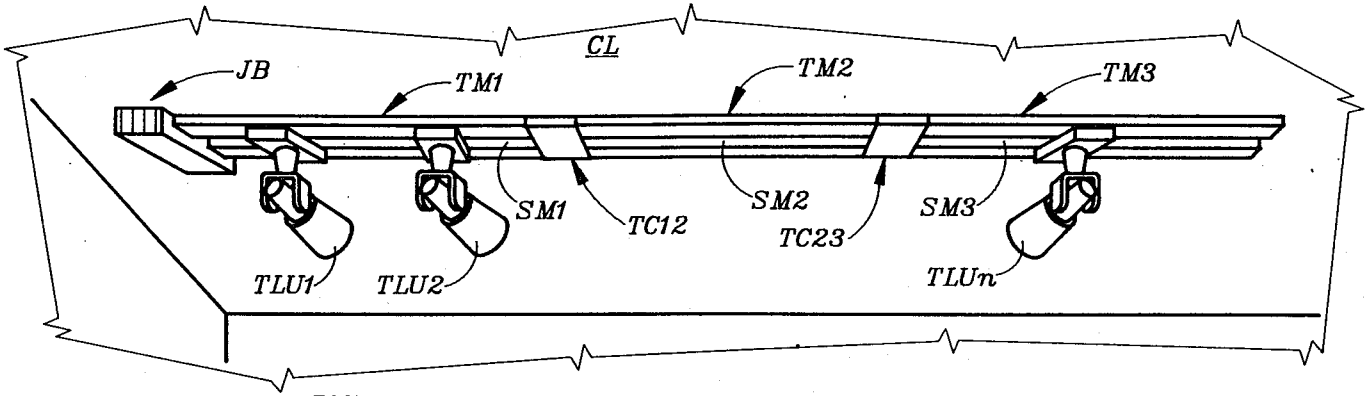
FIG. 1 illustrates a typical installation of an ordinary track lighting system.

In FIG. 1, JB represents an electrical junction box in a ceiling CL. Fastened to and extending along the ceiling from this junction box is a first track section or track module TM1. Connected with TM1 by way of track connection means TC12 is a second track module TM2; and connected with TM2 by way of track connection means TC23 is a third track module TM3.

Respectively, these tracks comprise slot means SM1, SM2, and SM3, by way of which a number of track lighting units TLU1, TLU2,—TLUn are removably fastened to and connected with the track, all asccording to practices well known in the art.

Figure 2:
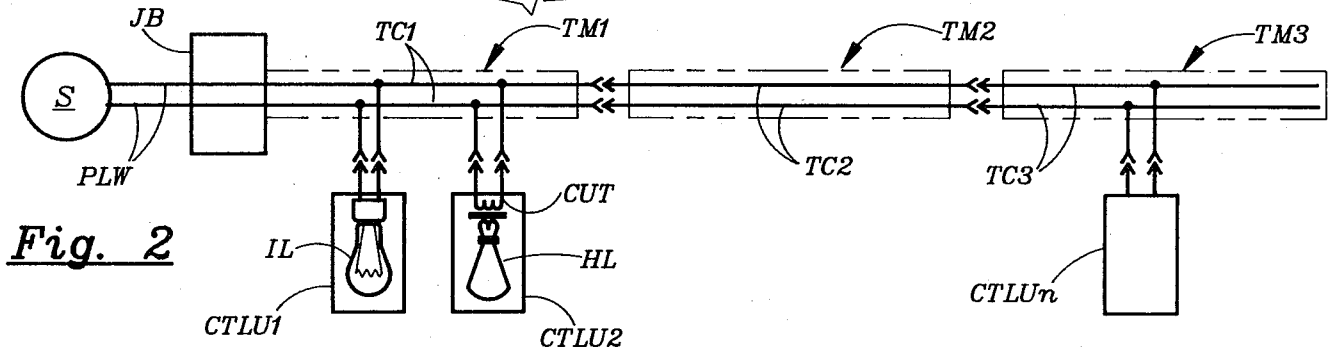
FIG. 2 diagrammatically illustrates the electrical circuit arrangement of a typical present track lighting system.

In FIG. 2, a source S provides a 120 Volt/60 Hz voltage across a pair of power line wires PLW, which power line wires enter junction box JB. A pair of track conductors TC1 in the first track module connects directly with these power line wires. These track conductors extend for the length of track module TM1. Disconnectably connected with the first track module TM1 is the second track module TM2, which comprises a second pair of track conductors TC2; and disconnectably connected with TM2 is the third track module TM3, which comprises a third pair of track conductors TC3. To the track conductors, at different points along the track modules, are connected a number of conventional track lighting units CTLU1, CTLU2,—CTLUn.

Track lighting unit CTLU1 comprises an ordinary 120 Volt incandescent lamp IL, the electrical terminals of which are disconnectably connected directly across the track conductors.

Track lighting unit CTLU2 comprises a 12 Volt Halogen lamp HL, the electrical terminals of which are connected with the secondary winding of a conventional 60 Hz step-down voltage transformer CVT. The primary winding of this transformer is disconnectably connected directly across the track conductors. The secondary winding of transformer CVT is electrically isolated from its primary winding.

The operation of the typical prior-art track lighting system illustrated by FIG. 1 and FIG. 2 is well known and need not be further explained here.

DESCRIPTION OF THE PREFERRED EMBODIMENT

Figure 3:
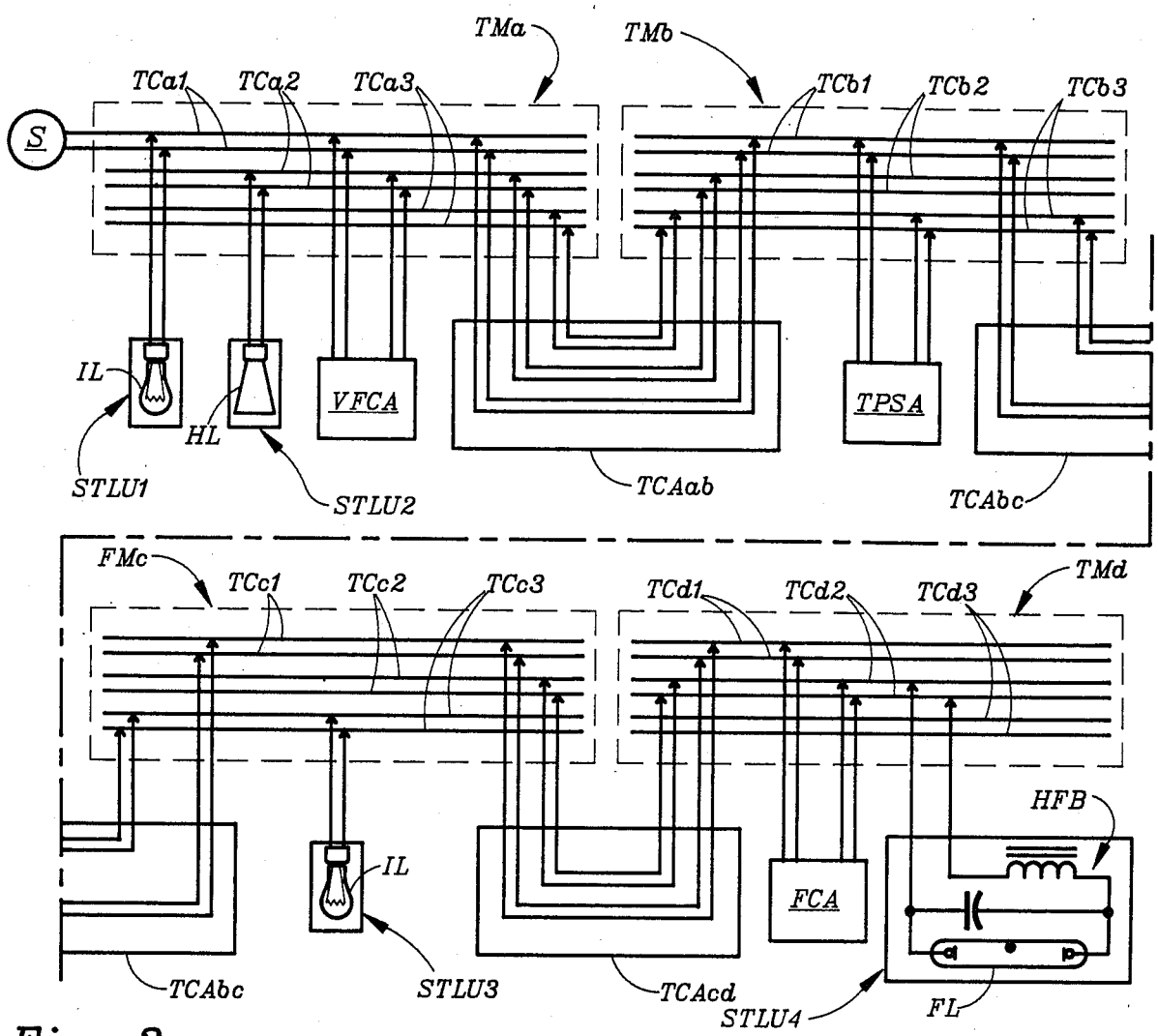
FIG. 3 diagrammatically illustrates the electrical circuit arrangement of the preferred embodiment of subject invention.

FIG. 3 provides a schematic illustration of the electrical arrangement of a track lighting system according to the present invention.

The system consists of four track sections or modules, TMa, TMb, TMc and TMd, with each track module having three pairs of track conductors: TCa1, TCa2 and TCa3 for track module TMa; TCb1, TCb2 and TCb3 for track module TMb; TCc1, TCc2 and TCc3 for track module TMc; and TCd1, TCd2 and TCd3 for track module TMd.

Track conductors TCa1 are connected with 120 Volt/60 Hz power line source S by way of power line wires PLW.

Plugged into track module TMa and connecting with track conductors TCa1 is a special track lighting unit STLU1 (which unit comprises an ordinary incandescent lamp IL) and a voltage/frequency converting adapter VFCA. The output from VFCA, which is a 120 Volt/30 kHz voltage, is provided directly to track conductors TCa2. Also plugged into track module TMa, but making contact with track conductors TCa2, is special track lighting unit STLU2, which comprises a 12 Volt Halogen lamp HL.

Plugged into both track modules TMa and TMb is track connection adapter TCAab, which provides for direct electrical connection between track conductors TCa1 and TCb1, between TCa2 and TCb2, and between TCa3 and TCb3.

Plugged into track module TMb and making contact with track conductors TCb1 and TCb3 is a time-programmable switching adapter TPSA.

Plugged into both track modules TMb and TMc is track connection adapter TCAbc, which provides for direct electrical connection between track conductors TCb1 and TCc1, and between TCb3 and TCc3.

Plugged into track module TMc and making contact with track conductors TCc3 is track lighting unit STLU3, which comprises an ordinary incandescent lamp IL.

Plugged into both track modules TMc and TMd is track connection adapter TCAcd, which provides for direct electrical connection between track conductors TCc1 and TCd1, and between TCc2 and TCd2.

Plugged into track module TMd and connecting with track conductors TCd1 is a frequency-converting adapter FCA. The output from FCA, which is a 120 Volt/30 kHz voltage, is provided directly to track conductors TCd2. Also plugged into track module TMd and connecting with track conductors TCd2 is special track lighting unit STLU4; which comprises a fluorescent lamp FL with its associated high frequency ballast HFB.

Figure 4:
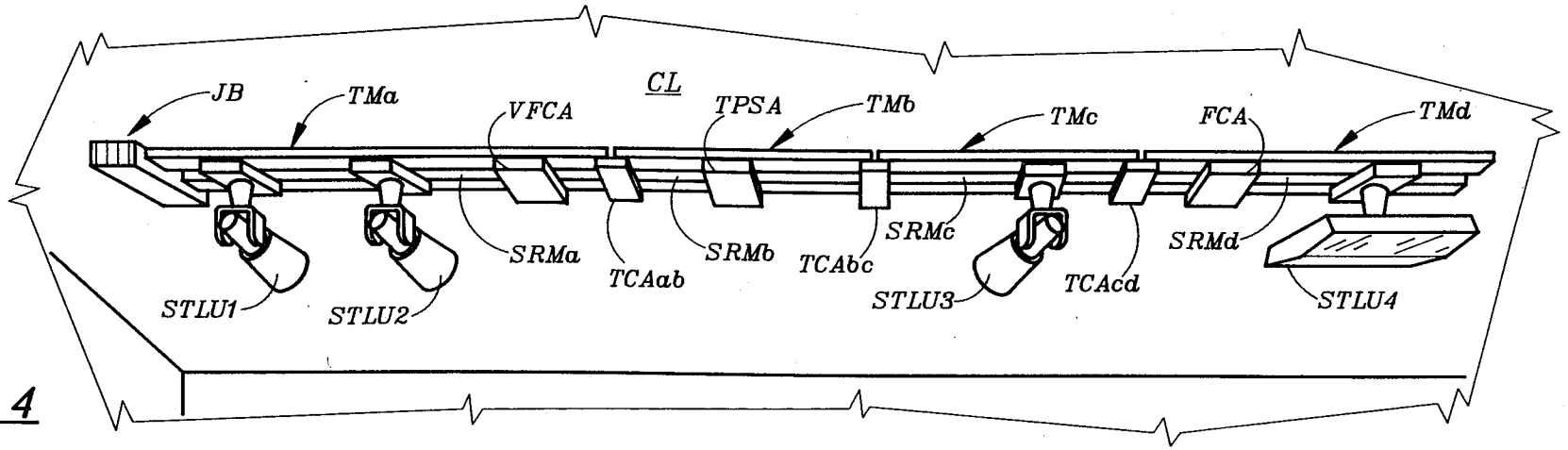
FIG. 4 illustrates an installation of a track lighting system according to the preferred embodiment.

FIG. 4 provides a schematic illustration of an installation of the track lighting system electrically illustrated by FIG. 3.

In FIG. 4, JB represents an electrical junction box in a ceiling CL. Fastened to and extending along the ceiling from this junction box are four track sections or modules TMa, TMb, TMc, and TMd—with TMa being located adjacent to JB.

Respectively, these track modules comprise slot receptacle means SRMa, SRMb, SRMc, and SRMd by way of which a number of track lighting units STLU1, STLU2, STLU3 and STLU4 are plugged into and removably connected with the track modules, as are also plug-in voltage-conditioning adapters VFCA, TPSA and FCA.

Plugged into both track module TMa and track module TMb is track connection adapter TCAab; plugged into both track module TMb and track module TMc is track connection adapter TCAbc; and plugged into both track module TMc and track module TMd is track connection adapter TCAcd.

Figure 5A:
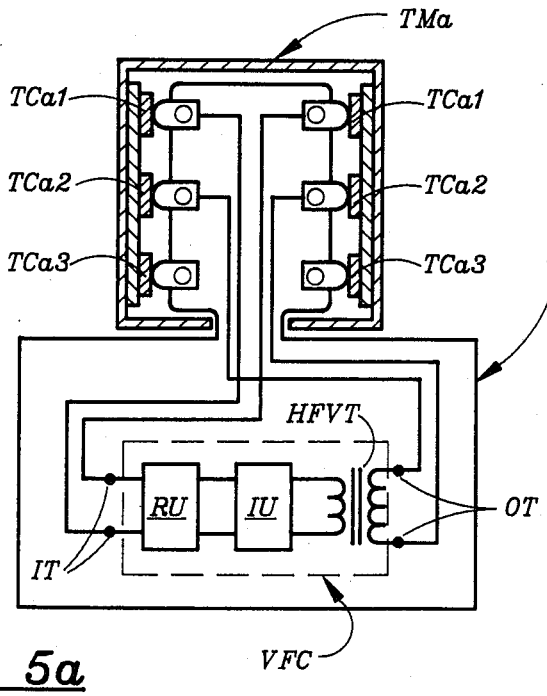
FIGS. 5*a* and 5*b* illustrate essential details of a voltage conditioning adapter.
Figure 5B:
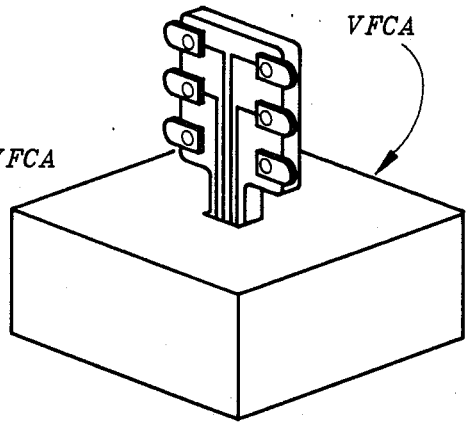

FIG. 5 provides schematic details of the voltage/frequency converting adapter VFCA and its connection with track module TMa. FIG. 5*a* represents a quasi cross-sectional view of TMa and VFCA, showing track conductors TCa1, TCa2 and TCa3 and their connections with input terminals IT and output terminals OT of voltage/frequency converter VFC. In turn, VFC consists of rectifier unit RU, inverter unit IU, and isolating high-frequency voltage transformer HFVT. FIG. 5*b* provides a perspective view of the complete voltage/frequency converting adapter VFCA.

The operation of the track lighting system of FIG. 3 and FIG. 4 may be explained as follows.

The track modules are substantially of ordinary design and construction, and each has three pairs of track conductors.

The track lighting units adapted to be plugged into and held by these track modules (i.e., STLU1, STLU2, STLU3, STLU4, etc.) are so designed that, when plugged into one of the track modules, they will each make electrical contact with but one of the three pairs of track conductors. By arbitrary choice, the No. 1 track-conductor-pair (i.e., TCa1, TCb1, TCc1, TCd1, etc.) has been provided with the regular 120 Volt/60 Hz power line voltage; which therefore implies that all track lighting units requiring non-conditioned 120 Volt/60 Hz voltage are so keyed as automatically to make contact with this No. 1 track-conductor-pair when plugged into one of the track modules.

For the particular arrangement illustrated by FIG. 3, the track connection adapters (i.e., TCAab, TCAbc, TCAcd, etc.) provide for electrical connection between track modules in the following way: (i) all the track modules have their No. 1 track-conductor-pairs connected together; (ii) track modules TMa and TMb have their No. 2 track-conductor pairs tied together; (iii) track modules TMa, TMb and TMc have their No. 3 track-conductor-pairs connected together; and (iv) track modules TMc and TMd have their No. 2 track-conductor-pairs connected together.

However, it should be noted that—by proper choice of track connectors—any suitable pattern of interconnections between track-conductor-pairs may be achieved. Also, it should be noted that the track connection adapters may contain functions more comprehensive than simple direct connection. In fact, all the functions that may be provided by the various voltage-conditioning adapters, may also be included or combined with the track connection adapters.

The voltage-conditioning adapters (i.e., VFCA, TPSA, FCA, etc.) are designed and constructed such as to permit keyed plug-in connection with the track modules. Normally, each of these voltage-conditioning adapters would have a pair of input terminals and a pair of output terminals; and, when plugged into a track module, a given voltage-conditioning adapter will automatically provide for its input terminals to be connected with a specific one of the track-conductor-pairs, and for its output terminals to be connected with another specific one of the track-conductor-pairs. In general, the function of such a voltage-conditioning adapter is that of controlling the flow of power between the two specific track-conductor-pairs.

In the particular arrangement of FIG. 3, adapter VFCA—being plugged into track module TMa—is being powered by 120 Volt/60 Hz voltage from track conductors TCa1, and provides 12 Volt/30 kHz output voltage to track conductors TCa2; which implies that any track lighting unit plugged into TMa and making contact with track conductors TCa2 will be provided with this 12 Volt/30 kHz voltage; which further implies that 12 Volt Halogen lamps, such as that of STLU2, can be properly powered directly from track conductors TCa2 in track module TMa, while ordinary 120 Volt incandescent lamps can be properly powered directly from track conductors TCa1.

Thus, with its particular arrangement of track lighting units, track connection adapters, and voltage-conditioning adapters (which in general are termed track plug-in units), the track lighting system of FIG. 3 exhibits the following overall operational characteristics:

(a) All track modules provide for the 120 Volt/60 Hz power line voltage on their No. 1 track-conductor-pairs; which means that a track lighting unit requiring such an operating voltage may be plugged into and properly operated from any point along the complete track. Thus, track lighting unit STLU1 is ON whenever the track is connected to the power line.

(b) Track modules TMa and TMb provide for 12 Volt/30 kHz voltage on their No. 2 track-conductor-pairs; which means that a track lighting unit requiring such an operating voltage may be plugged into and properly operated from any point along these two track modules. Thus, track lighting unit STLU2 is ON whenever the track is connected to the power line.

(c) Track modules TMa, TMb and TMc provide for a time-programmed 120 Volt/60 Hz voltage on their No. 3 track-conductor-pairs; which means that a track lighting unit requiring such an operating voltage, and which at the same time should be turned ON and/or OFF according to a time program, may be plugged into and properly operated from any point along these three track modules. Thus, track lighting unit STLU3 is turned On and/or OFF in accordance with the time program provided by the time-programmable switching adapter TPSA.

(d) Track modules TMc and TMd provide for 120 Volt/30 kHz voltage on their No. 2 track-conductor-pairs; which means that a track lighting unit requiring such an operating voltage may be plugged into and properly operated from any point along these two track modules. Thus, track lighting unit STLU4 is ON whenever the track is connected to the power line.

In general respect to the track lighting system herein disclosed, it is noted that it is not always necessary that the individual track-conductor-pairs be totally independent of one another. Instead, for instance, it would be possible in many applications to use an arrangement where one of the conductors of two or more of the several track-conductor-pairs is combined into a common conductor. Thus, for instance, a track with two track-conductor-pairs would only need to comprise three actual conductors.

Also, it is noted that most of the functions provided by a plurality of connected track modules can be accomplished by way of a single long track module, provided that the individual conductors within that long track module are provided in suitably separated or segmented sections—with these sections being electrically isolated from one another, and with each such section being shorter than the total length of the track.

The voltage/frequency converting adapter VFCA of FIG. 5 is illustrative of other voltage-conditioning adapters. In fact, any kind of voltage-conditioning means may be interposed between input terminals IT and output terminals OT, thereby to provide a corresponding voltage-conditioning adapter operable to provide conditioned voltage onto the particular pair of track conductors connected with output terminals OT.

For instance, the time-programmable switching adapter TPSA is made in substantially the same fashion as is VFCA, except for having its output terminals OT connected differently and for having a time-programmable switch means connected between input terminals IT and output terminals OT instead of voltage/frequency converter VFC. The time-programmable switch means may be of any ordinary kind, such as for instance of the type called Security Switch and marketed by Diablo Technologies, Inc. of San Ramon, Calif. 94583.

It is believed that the present invention and its several attendant advantages and features will be understood from the preceeding description. However, without departing from the spirit of the invention, changes may be made in its form and in the construction of its constituent parts; the form herein presented merely representing its presently preferred embodiment.

I claim:

1. A track lighting system comprising:

at least one track section adapted for mounting onto a surface, said track section comprising two pairs of track conductors and a receptacle slot adapted to receive and hold a number of track plug-in units, one of said pairs of track conductors being connected with a source of electric power; and at least one track plug-in unit having electrical terminal means operable to make contact with said pairs of track conductors and operable to effect flow of electric energy therebetween.

2. A track lighting system comprising at least one track section adapted for mounting onto a surface, said section comprising at least two pairs of track conductors and a receptacle slot adapted to receive and hold a number of track plug-in units, each of said plug-in units having electrical terminal means operable to make contact with at least one of said pairs of track conductors, with at least one of said plug-in units being adapted to make contact with at least two of said pairs of track conductors and operable to effect flow of electric energy therebetween.

3. A plug-in voltage-conditioning adapter operable to be inserted into and held by a power track having at least two pairs of track conductors, one of said pairs of track conductors being connected with a source of electric power, said adapter comprising:

means for making electrical contact with both of said pairs of track conductors and for controllably effecting flow of power therebetween.

4. A track lighting system comprising:

at least one track section adapted for mounting onto a surface, the track section having: (i) at least one pair of track conductors connected with an AC voltage of frequency substantially higher than that of the voltage normally present on an ordinary electric utility power line, and (ii) a receptacle slot adapted to receive and hold a number of track lighting units; and at least one track lighting unit operable: (i) to be received and held by the receptacle slot, (ii) when so held, to make contact with the track conductors, and (iii) to be powered by the AC voltage present thereon;

thereby permitting the use of track lighting units adapted to be properly powered only from an AC voltage of frequency substantially higher than that of the voltage normally present on an ordinary electric utility power line.

5. A track lighting system comprising:

power track means having track conductors connected with an AC voltage having: (i) magnitude about equal to that of the power line voltage on an ordinary electric utility power line, but (ii) frequency substantially higher than that of said power line voltage; and a track lighting unit operable to connect with the track conductors and, when so connected, to be properly operated by the AC voltage thereon.

6. A track lighting system comprising:

a source of voltage of first magnitude;

a voltage conditioning means connected in circuit with said source of voltage and adapted to provide at a pair of output terminals a voltage of second magnitude, said second magnitude being substantially different from said first magnitude;

at least one track section having a first and a second pair of track conductors and a receptacle slot adapted to receive and releasably hold a plurality of track lighting units, said first pair of track conductors being connected with said source of voltage, said second pair of track conductors being connected with said output terminals;

whereby lighting units requiring operating voltages of substantially different magnitude may simultaneously be used in and properly powered from said slot receptacle.

7. The system of claim 6 wherein the voltage of first magnitude and the voltage of second magnitude each have a frequency, and wherein the frequency of said voltage of first magnitude is substantially different from that of said voltage of second magnitude.

8. A plug-in adapter for a track lighting system, said track lighting system having a track section with a first and a second pair of track conductors and a receptacle slot, said first pair of track conductors being powered with AC voltage from a regular electric utility power line, said second pair of track conductors not being provided with said AC voltage, said plug-in adapter comprising:

plug-in means having a first pair and a second pair of terminals and being insertable into said receptacle slot, thereby to provide for direct electrical contact between said first pair of track conductors and said first pair of terminals, as well as between said second pair of track conductors and said second pair of terminals; and voltage conditioning means connected in circuit between said first pair of terminals and said second pair of terminals, said voltage conditioning means being operable to convert the voltage provided at said first pair of terminals into an output voltage of converted electrical parameters, said output voltage being supplied to said second pair of terminals.

9. The adapter of claim 20 wherein the magnitude of said output voltage is approximately 12 Volt RMS and the frequency of said output voltage is on the order of 30 kHz.

10. A track lighting system comprising:

a track section having a first pair and a second pair of track conductors and a receptacle slot adapted to receive and releasably hold a plurality of track plug-in lighting units and track plug-in adapters, said first pair of track conductors being provided with a voltage;

at least one track plug-in lighting unit adapted to plug into and make contact with said second pair of track conductors; and a track plug-in adapter adapted to plug into and make contact with both said first pair and said second pair of track conductors and, when so plugged in, operable to effect flow of electric power therebetween;

whereby the flow of power to said at least one track plug-in lighting unit can be substantially affected by said plug-in adapter.

11. The system of claim 10 wherein said first pair of track conductors is connected with an ordinary electric utility power line and where said voltage is 120 Volt/60 Hz.

12. The system of claim 10 wherein at least one of the conductors of said second pair of track conductors is segmented into at least two separate pieces that are electrically non-connected with one another.

13. A track lighting system comprising:

a source of voltage of a first frequency;

a voltage conditioning means connected in circuit with said source of voltage and adapted to provide at a pair of output terminals a voltage of a second frequency, said second frequency being substantially different from said first frequency;

at least one track section having a first and a second pair of track conductors and a receptacle slot adapted to receive and releasably hold a plurality of track lighting units, said first pair of track conductors being connected with said source of voltage, said second pair of track conductors being connected with said output terminals;

whereby lighting units requiring operating voltages of substantially different frequencies may simultaneously be used in and properly powered from said receptacle slot.

14. The system of claim 13 wherein said source of voltage is an ordinary electric utility power line and wherein said voltage conditioning means comprises a frequency converter.

15. The system of claim 13 wherein said voltage conditioning means is adapted to plug into said receptacle slot, thereby to make contact with both said first pair and said second pair of track conductors.

16. A combination comprising:

frequency converter means operative to connect with the power line voltage of an ordinary electric utility power line and, when so connected, to provide an AC voltage to a pair of track conductors in an electrical power track means, the AC voltage being of frequency substantially different from that of the power line voltage, the track conductors being accessible for connection with a load means, the power track being adapted for mounting on a substantially flat surface; and track lighting means operative to make contact with the track conductors and to provide light in response to the AC voltage provided thereat.

17. The combination of claim 16 wherein: (i) the frequency of the AC voltage is substantially higher than that of the power line voltage, and (ii) the track lighting means is operative to be properly powered by the AC voltage but not by the power line voltage.

18. The combination of claim 16 wherein: (i) the frequency of the AC voltage is substantially higher than that of the power line voltage, and (ii) the magnitude of the AC voltage is approximately the same as that of the power line voltage:

thereby permitting the use of track lighting means particularly adapted to be powered by an AC voltage of magnitude about equal to that of the power line voltage, but of frequency substantially higher than that of the power line voltage.

19. A track lighting system comprising:

a set of track sections, each section having at least a first pair and a second pair of track conductors and a receptacle slot adapted to receive and removably hold a number of track plug-in units, each track plug-in unit being operable upon insertion into the receptacle slot to make contact with at least one of said pairs of track conductors;

means by which to connect voltage from an ordinary electric utility power line to said first pair of track conductors; and a plurality of track plug-in units, at least one of said track plug-in units being a voltage-conditioning adapter operable to make contact with both said first pair and said second pair of track conductors and to effect flow of power therebetween, and at least one of said track plug-in units being a track lighting unit operable to make contact with said second pair of track conductors and to be powered by way of said voltage-conditioning adapter.

20. The system of claim 19 wherein said voltage-conditioning adapter comprises frequency and voltage converting means.

21. The system of claim 20 wherein said voltage-conditioning adapter also comprises power line isolation means.

22. A track lighting system comprising:

a track section having a first pair and a second pair of track conductors and a receptacle slot adapted to receive and releasably hold a plurality of track plug-in units and track plug-in adapters, said first pair of track conductors being provided with the voltage from a regular electric utility power line;

at least one track plug-in lighting unit adapted to plug into and make contact with said second pair of track conductors; and at least one track plug-in adapter adapted to plug into and make contact with both said first pair and said second pair of track conductors and, when so plugged in, operable to effect flow of power therebetween.

23. The system of claim 22 wherein said at least one track plug-in adapter comprises frequency conversion means.

24. The system of claim 23 wherein said frequency conversion means provides for voltage magnitude transformation.

25. A voltage-conditioning adapter for a track lighting system, said track lighting system having a track section with a first and a second pair of track conductors and a receptacle slot, said first pair of track conductors being connected with a source of electric power, said adapter comprising:

plug-in means having a first pair and a second pair of terminal and being insertable into said receptacle slot, thereby to provide for direct electrical contact between said first pair of track conductors and said first pair of terminals, as well as between said second pair of track conductors and said second pair of terminals; and voltage conditioning means connected in circuit between said first pair of terminals and said second pair of terminals, said voltage conditioning means being operable to effect flow of electric power therebetween.

26. The adapter of claim 25 wherein said voltage conditioning means comprises a frequency conversion means.

27. The adapter of claim 25 wherein said voltage conditioning means comprises a voltage magnitude transformation means.

28. The adapter of claim 25 wherein said first pair of track conductors is adapted to connect with an ordinary electric utility power line.

29. The adapter of claim 29 wherein said voltage conditioning means comprises a voltage and frequency conversion means.

* * * * *